US007524544B2

(12) United States Patent
Truong

(10) Patent No.: US 7,524,544 B2
(45) Date of Patent: Apr. 28, 2009

(54) REALISTIC MODEL PLANT STRUCTURE

(76) Inventor: Thanh Kim John Truong, 11971 Mahogany Dr., Garden Grove, CA (US) 92840

( * ) Notice: Subject to any disclaimer, the term of this patent is extended or adjusted under 35 U.S.C. 154(b) by 425 days.

(21) Appl. No.: 11/260,704

(22) Filed: Oct. 27, 2005

(65) Prior Publication Data

US 2007/0098924 A1 May 3, 2007

(51) Int. Cl.
*A47G 33/06* (2006.01)
*A41G 1/00* (2006.01)

(52) U.S. Cl. ..... 428/18; 428/27; 156/61; 493/956

(58) Field of Classification Search ..... 428/17, 428/18, 19, 20, 27; 156/61; 493/956; *A47G 33/06*
See application file for complete search history.

(56) References Cited

U.S. PATENT DOCUMENTS 1,829,687 A * 10/1931 Takiguchi ..... 428/18
3,317,365 A * 5/1967 Reichert et al. ..... 428/18
3,766,376 A * 10/1973 Sadacca et al. ..... 40/433
4,774,113 A * 9/1988 Shaffer ..... 428/18
5,333,226 A * 7/1994 Stephens ..... 385/100
5,962,088 A * 10/1999 Tanaka et al. ..... 428/18
6,037,021 A * 3/2000 Koo ..... 428/10
6,139,168 A * 10/2000 Gary et al. ..... 362/252
D475,320 S * 6/2003 Hensley et al. ..... D11/157
D505,638 S * 5/2005 Tabor ..... D11/125
6,923,641 B1 * 8/2005 Tabor ..... 431/125
7,055,980 B2 * 6/2006 Wu ..... 362/123
2004/0109853 A1 * 6/2004 McDaniel ..... 424/94.6

FOREIGN PATENT DOCUMENTS

JP 2000109725 A * 4/2000

* cited by examiner

*Primary Examiner*—John J. Zimmerman
*Assistant Examiner*—Aaron Austin
(74) *Attorney, Agent, or Firm*—Blakely, Sokoloff, Taylor & Zafman

(57) ABSTRACT

An embodiment of the present invention is a technique to create plant model with realism. A tree core having a trunk and branches is created. The tree core is pre-coated with a clear oil-based liquid. A coat is formed to cover the tree core with a composite mixture. The composite mixture contains at least a paint component, a color pigment, a binder component, and a glue component.

18 Claims, 10 Drawing Sheets

REALISTIC MODEL PLANT STRUCTURE

BACKGROUND

1. Field of the Invention

Embodiments of the invention relate to the field of model landscapes, and more specifically, to model plant structures.

2. Description of Related Art

Models for natural landscapes are used in a number of applications ranging from architectural models to movie film making. The basic elements of natural landscapes or scenes are plant structures, foliage, flowers, etc. It is important to provide realism to these models for faithful reproduction of the natural landscapes or scenes.

Most models for plant structures are not sufficiently realistic with natural details. In addition, the models may not be durable enough for an extended display or may cause manufacturing difficulties.

BRIEF DESCRIPTION OF THE DRAWINGS

Embodiments of invention may best be understood by referring to the following description and accompanying drawings that are used to illustrate embodiments of the invention. In the drawings.

DESCRIPTION

An embodiment of the present invention is a technique to create plant model with realism. A tree core having a trunk and branches is created. The tree core is pre-coated with a clear oil-based liquid. A coat is formed to cover the tree core with a composite mixture. The composite mixture contains at least a paint component, a color pigment, a binder component, and a glue component.

In the following description, numerous specific details are set forth. However, it is understood that embodiments of the invention may be practiced without these specific details. In other instances, well-known circuits, structures, and techniques have not been shown to avoid obscuring the understanding of this description.

One embodiment of the invention may be described as a process which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a program, a procedure, a method of manufacturing or fabrication, etc.

Figure 1:
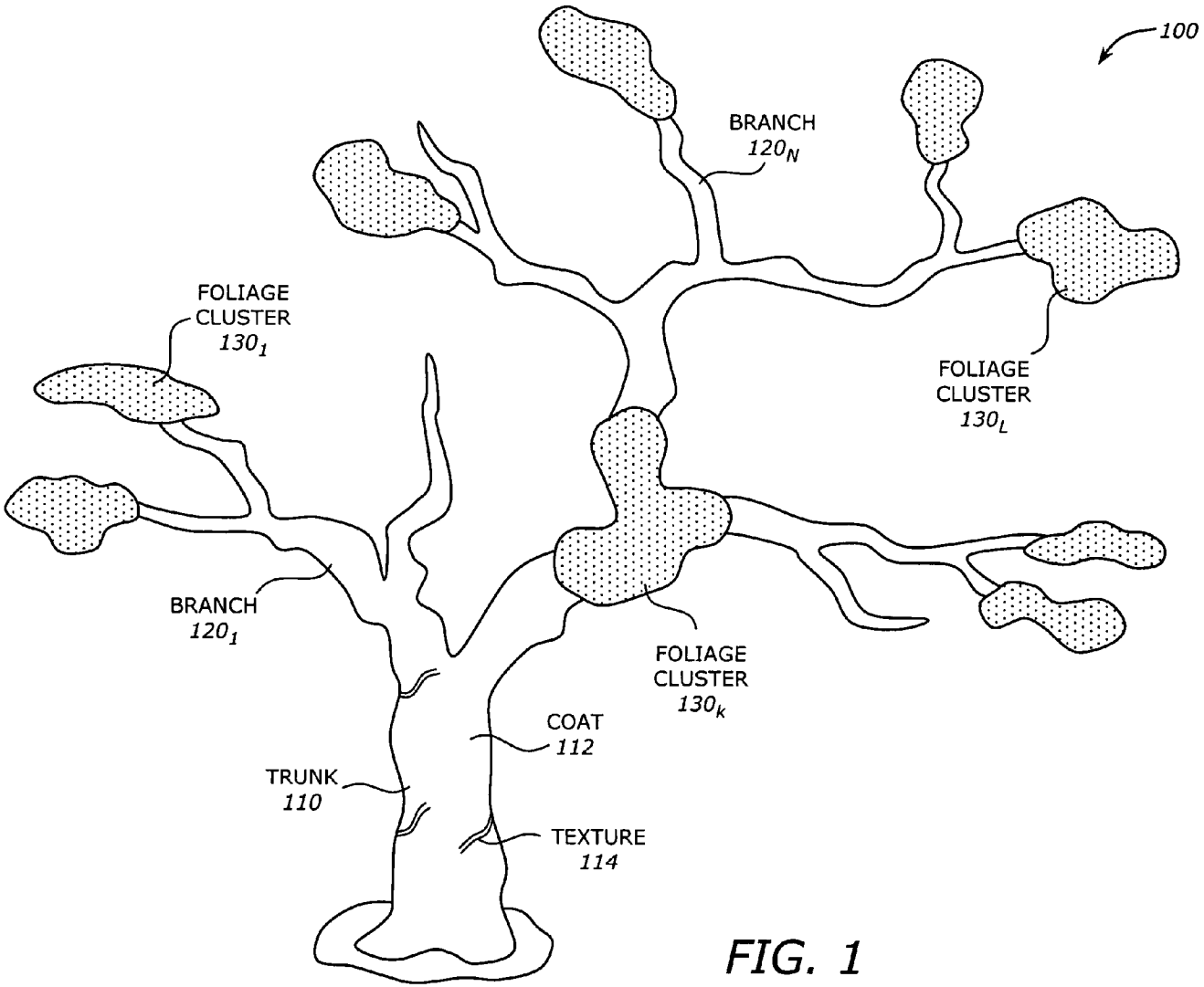
FIG. 1 is a diagram illustrating a plant model in which one embodiment of the invention can be practiced.

FIG. 1 is a diagram illustrating a plant model 100 in which one embodiment of the invention can be practiced. The plant model 100 includes a trunk 110, branches $\mathbf{120}_1$ to $\mathbf{120}_N$, and foliage clusters $\mathbf{130}_1$ to $\mathbf{130}_L$. The plant model is a a miniature or scaled model of a plant such as a tree.

The trunk 110 is the main axis of the plant model. It is covered by a coat 115 and may have texture 114. The trunk may have any shape suitable for the type of plant being constructed. The coat 115 provides a realistic cover of the trunk. It may have any color suitable for the type of plant being constructed. The texture 114 includes any regular or irregular pattern of roughness on the coat 115.

Figure 2A:
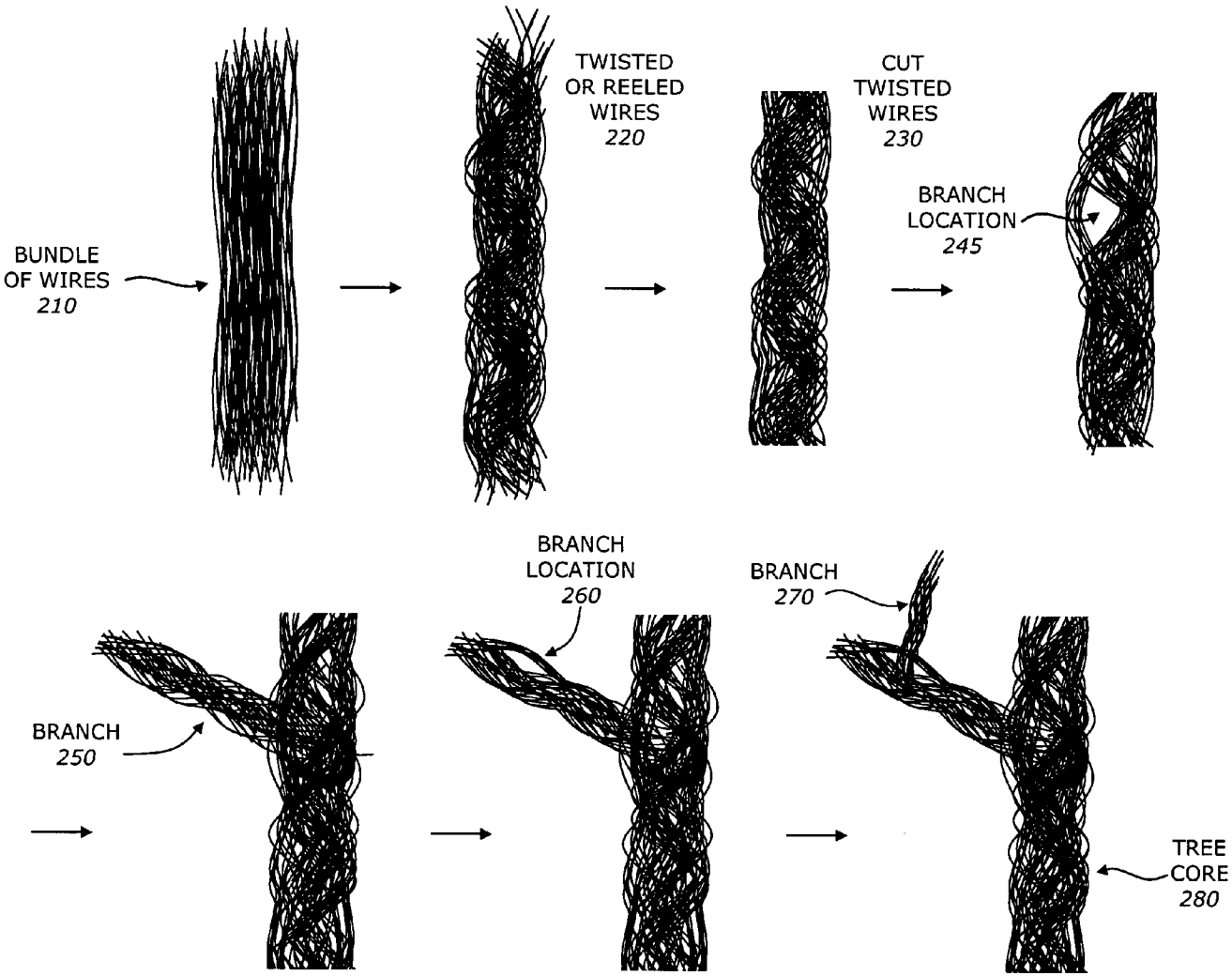
FIG. 2A is a diagram illustrating a sequence of operations to form a tree core according to one embodiment of the invention.

FIG. 2A is a diagram illustrating a sequence 200 of operations to form a tree core according to one embodiment of the invention.

The sequence 200 starts with obtaining a bundle of wires 210. The number of wires depends on the size of the trunk. It may range from 5 to 150. The wires are typically metallic wires such as iron, aluminum, or any other suitable materials. The wire strand may be of size 0.03 to 0.06 mm. If the wires are too hard, they may be pre-heated to a pre-determined temperature to become softer so that they may be twisted or bent easily. Then, the bundle 210 is twisted or reeled into twisted wires 220. The twisting may be performed manually or mechanically with a special equipment. The twisting helps keep the wires stayed together to form a solid trunk. The twisted wires are then cut to a desired length depending on the type of tree to become cut twisted wires 230. After the core of the trunk is formed, locations for branches are selected. The wires at the selected branch locations are then loosened. This may be done by slightly pulling out one or two wires at the locations.

Another bundle of wires is used to form the core of a branch 250. The number of wires for this bundle is less then the number of wires for the trunk. This bundle is also twisted to reeled to form a solid branch core. The branch core is then attached or hooked to the branch location. The loosened wires at the branch locations are then tightened to firmly keep the branch in place. Then, locations of sub-branches are selected on the branch. The wires at these sub-branch locations are loosened at the sub-branch locations such as a sub-branch location 260. A bundle of wires is then use to form the core of the sub-branch 270. The sub-branch 270 is then attached to connected, or hooked at the sub-branch location 260. The wires at the sub-branch location are then tightened to keep the sub-branch 270 firmly attached to the branch 250 at the sub-branch location 260. The process of creating sub branches is then repeated on the branches until sufficient number of branches or sub-branches has been reached. The final result of the sequence 200 is a tree core 280.

FIG. 2A is a diagram illustrating a sequence 205 to form a tree core according to another embodiment of the invention.

The sequence 205 starts with obtaining a pre-formed trunk and branches 285. The pre-formed trunk and branches 285 may be obtained by a number of methods, such as cutting a tree shape from a metal sheet, pre-pressing, etc. The metal may be any suitable metal, such as iron, aluminum. The tree shape typically includes a trunk and the branches. Then, portions of the pre-formed trunk and branches 285 may be curled or twisted to form three-dimensional structure tree core 280. This may also be achieved by using metal wires to wrap around portions of the trunk or the branches.

Figure 3:
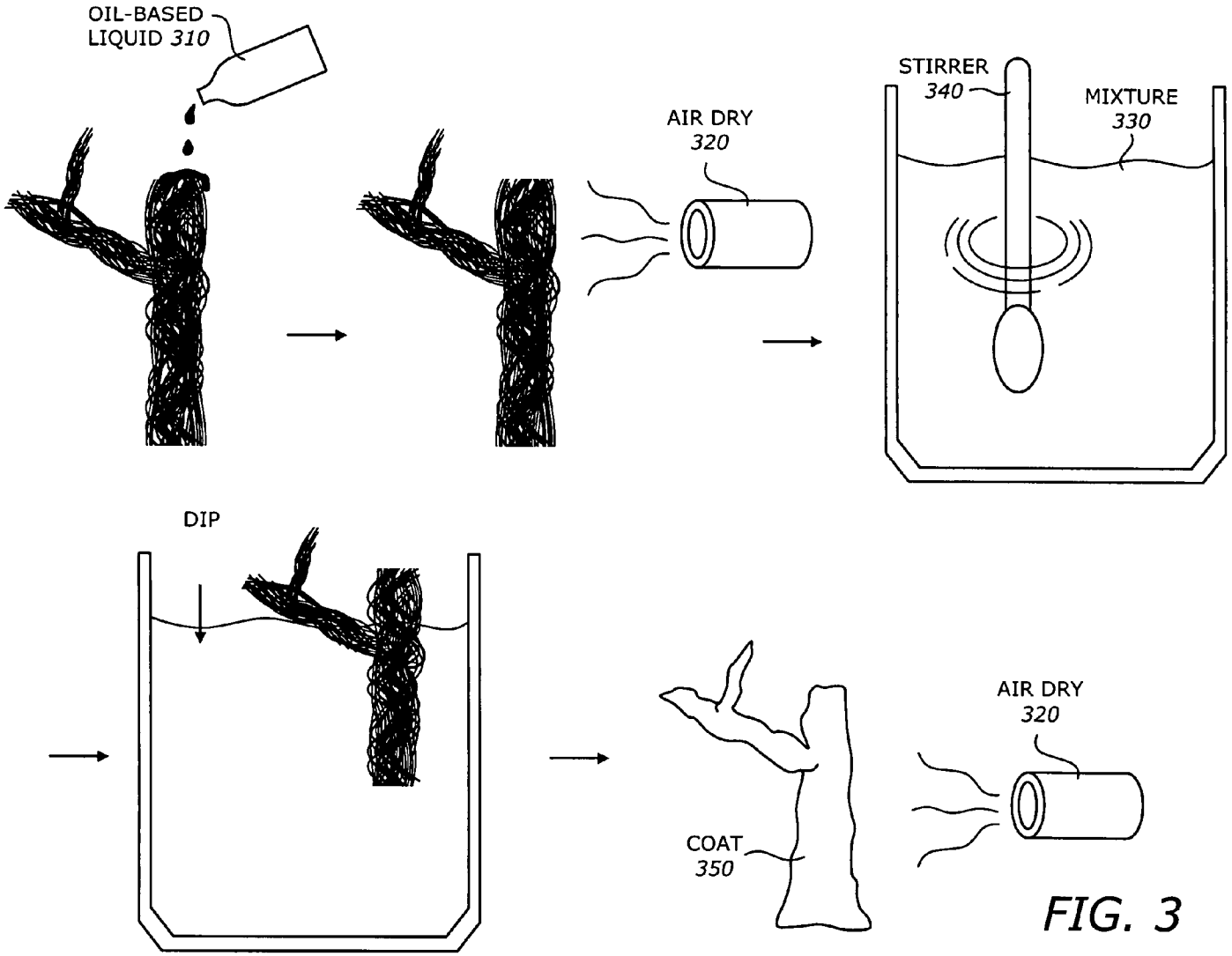
FIG. 3 is a diagram illustrating a sequence of operations to form a coat according to one embodiment of the invention.

FIG. 3 is a diagram illustrating a sequence 300 of operations to form a coat according to one embodiment of the invention.

Figure 2B:
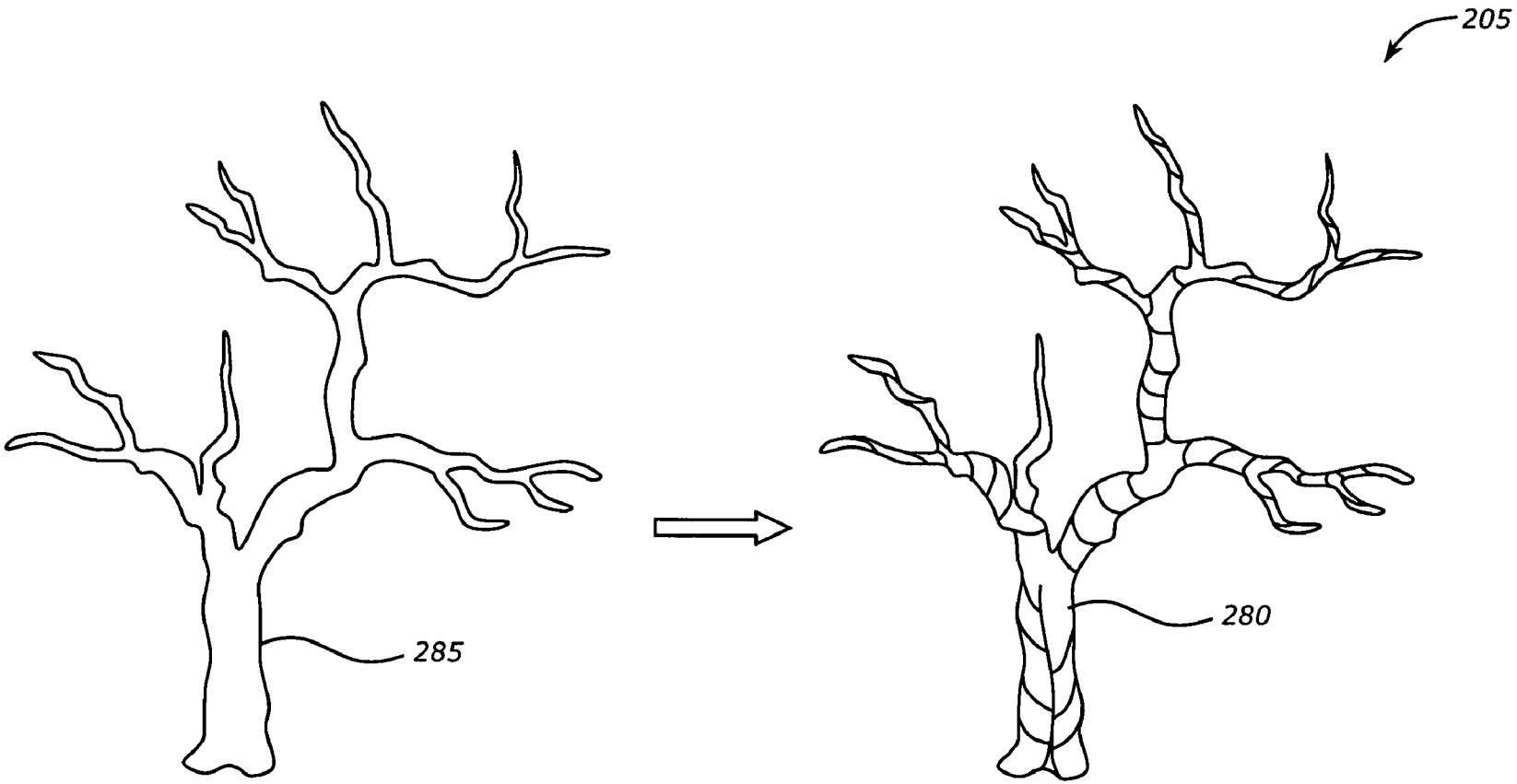
FIG. 2B is a diagram illustrating a sequence of operations to form a tree core according to another embodiment of the invention.

The sequence 300 starts with pre-coating the tree core 280 (from FIG. 2A or 2B) with a clear oil-based liquid 310. The oil-based liquid 310 is used to prevent rusting or oxidation of the tree core 280. It also helps in the bonding process between the tree core 280 and a final coating. The oil-based liquid 310 is applied to the entire tree core 280. Then it is air dried either by exposing in the open air or by blowing air around the tree core 280.

A composite mixture 330 is prepared for the coating. The mixture 330 is formed by mixing water-based or oil-based paint, water-based or oil-based color pigment, a binder component, a glue component, and other additives. The color pigment is selected according to the desired color for the tree. The glue component may be a latex rubber-like glue or similar adhesive. The composite mixture thus formed provides a realistic tree armature with good durability and flexibility to prevent cracking when the branches are re-shaped or bent. The composition of these components may be approximately as follows:

Water-based or oil-based paint: 40% to 60%
Water-based or oil-based color pigment: as needed
Binder component: 10% to 20%
Glue component: 25% to 35%
Other additives: 1% to 5%

The compositions may vary depending on several factors such as the type of tree, the material of the wires, the size of the tree core, etc. The mixture is thoroughly mixed a stirrer 340 or by any other mixing mechanism. After the mixture 330 is formed, the tree core 280 is dipped into the mixture 330 for some time period. The time period may depend on the size of the tree core and the material of the wires. It may be less than a minute to several minutes. The dipping is such that the bottom part is dipped more heavily than the upper part so that the bottom part looks larger than the upper part as in a natural tree. After dipping, the tree core 280 is air dried completely. Again this may be done by exposing the dipped tree core in the open air or by blowing air to the entire tree core 280. Then the coat 350 is examined to determine if it provides the realism as expected or desired. If not, the tree core 280 may be dipped into the mixture 330 again and it air dried. The process continues as many times as necessary to provide an acceptable coat. The coat such formed provides the tree's bark or coating. Further processing may be necessary to add more realism. The coat 350 therefore includes two layers: one layer from the oil-based liquid 310 and another layer from the mixture 330.

Figure 4:
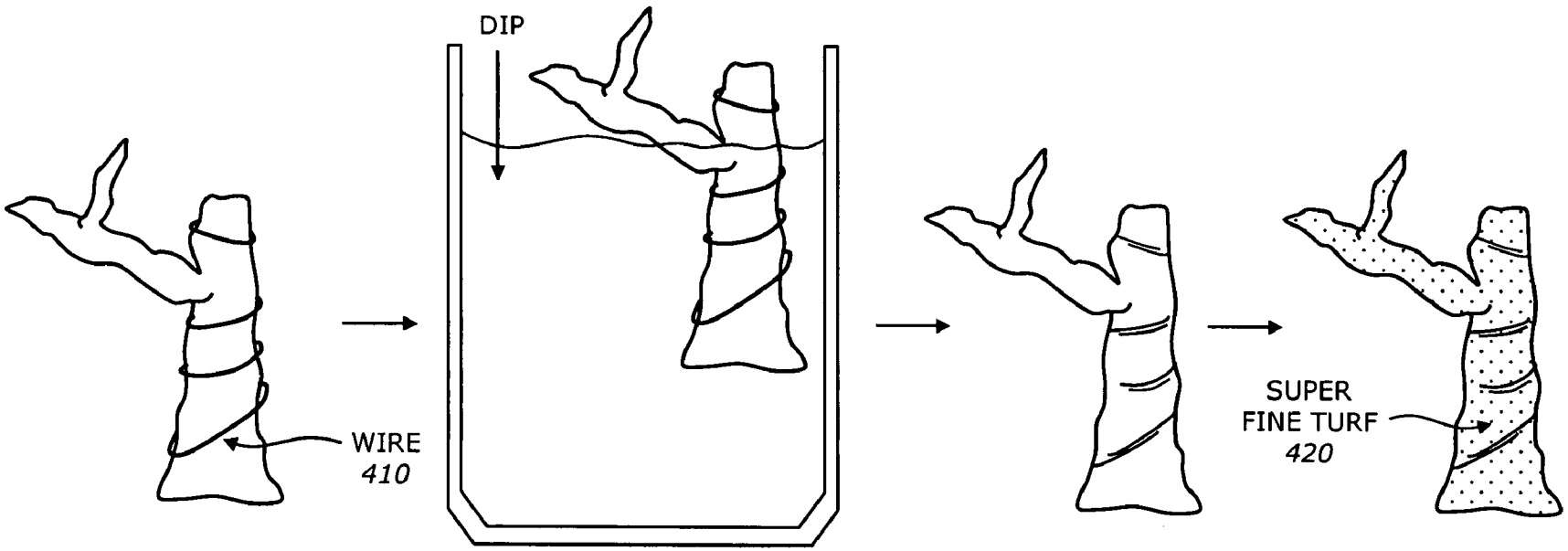
FIG. 4 is a diagram illustrating a sequence of operations to add texture according to one embodiment of the invention.

FIG. 4 is a diagram illustrating a sequence 400 of operations to add texture according to one embodiment of the invention. The sequence 400 adds texture or additional roughness to provide even more realism.

To add some texture to the coat, a coated wire 410 may be used. After the coat 350 is formed, a wire 410 may be wrapped around the coated tree core at areas that texture is desired. The wire 410 may be a single strand of wire similar to the wires used in creating the tree core described in FIG. 2. Then, the coated tree core wrapped by the wire 410 may be dipped again in the mixture 330 and then air dried as described above. Again, the process may be repeated as necessary to provide an acceptable level of realism.

The texture provided by the coated wire 410 may be sufficient for certain types of trees such as palms, royal palms, or Phoenix palms. Some other types may require additional roughness or uneven bark. This may be done by adding super fine turf or sand 420 to the coat 350. Brush retouch may also be performed to add natural look if necessary.

Figure 5:
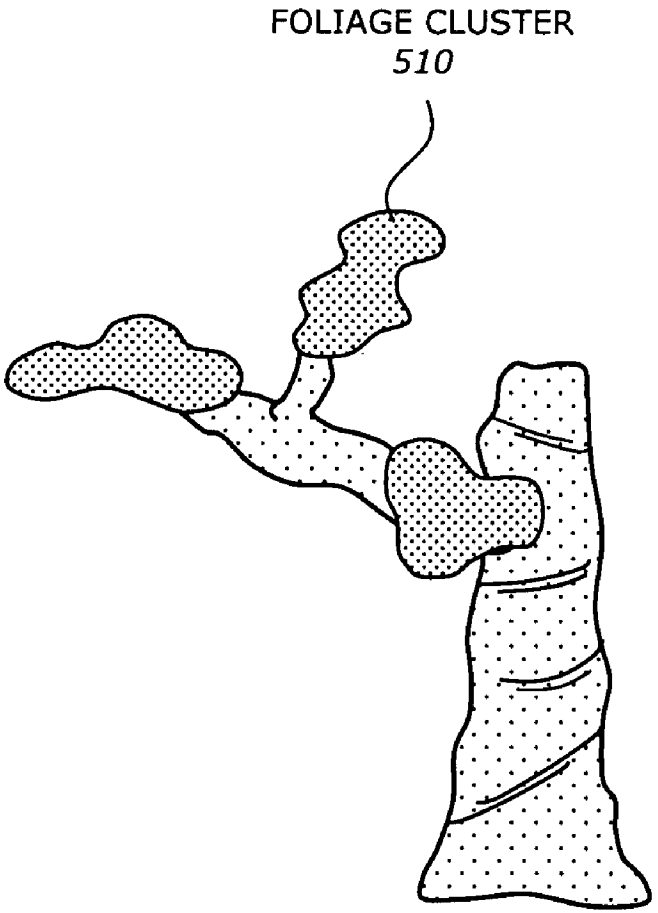
FIG. 5 is a diagram illustrating adding foliage cluster according to one embodiment of the invention.

FIG. 5 is a diagram illustrating adding foliage cluster according to one embodiment of the invention.

The foliage cluster is prepared by first spreading poly-fiber strands into a very thin sheet. Then a water or oil-based glue is sprayed with airbrush evenly over the thin sheet of poly-fiber. The water or oil-based glue may be diluted with water to make it less concentrated. The composition of water may be approximately 30%. Binder may also be added to the glue with a composition of about 10% to help bonding the materials together. Then the poly-fiber sheet is dipped into a container of turf with the desired color. The turf is the flocking material that represents the grass or tree leaves. The grit size is selected to represent the desired leaves' size. After dipping, the poly fiber sheet is allowed to dry until the poly fiber and the turf is completely bonded together.

After the foliage cluster is prepared, it may be cut into proper sizes to be glued to the specific branches of the coated tree core. The foliage cluster may be first stretched in four directions to make it thinner, looser, or airier. Then it is cut into small pieces about ½" to 2" depending on the size of the tree. The water or oil-based glue prepared above may be used to glue these small pieces at the branches of the tree as appropriate.

Figure 6:
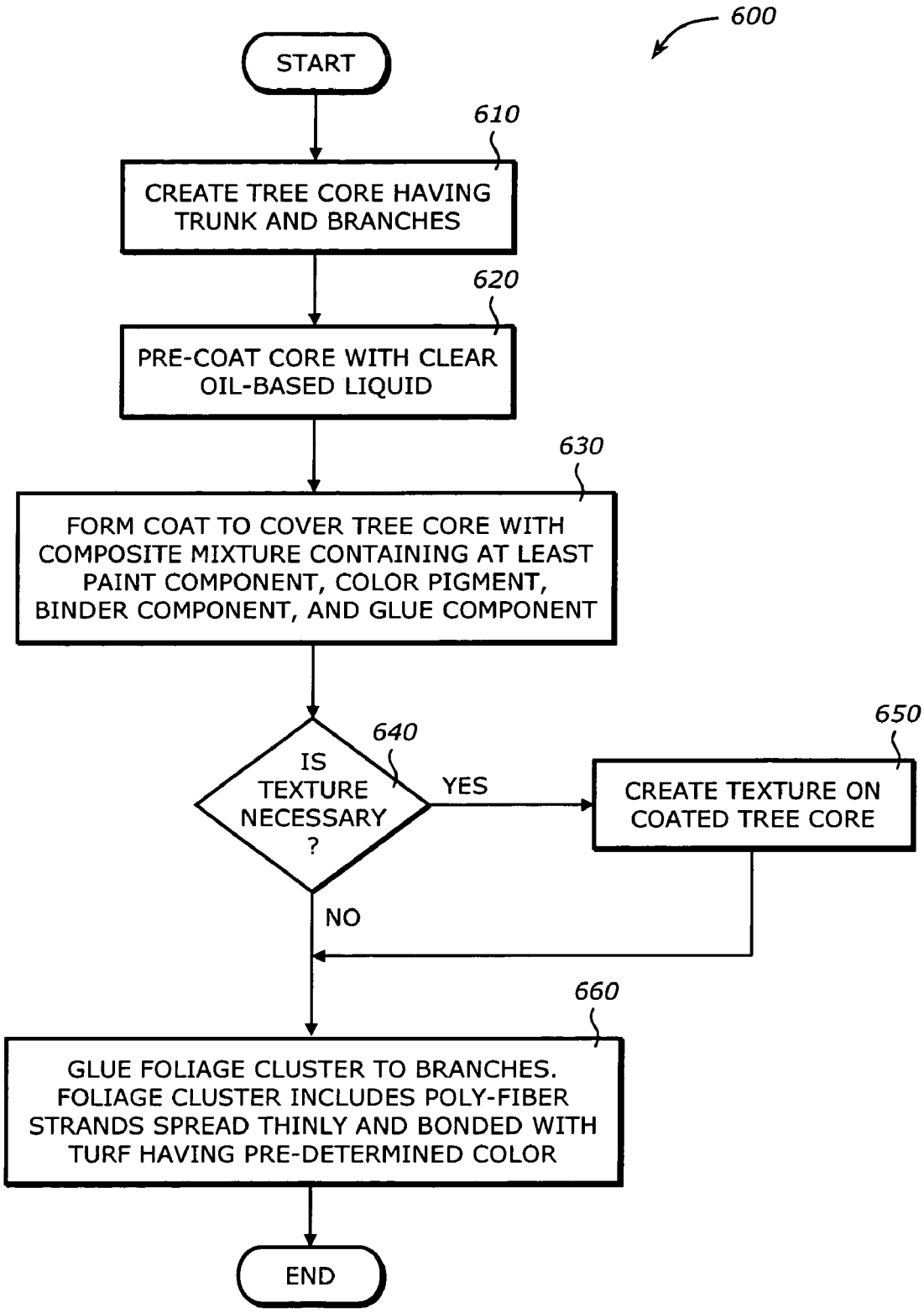
FIG. 6 is a flowchart illustrating a process to create a plant model according to one embodiment of the invention.

FIG. 6 is a flowchart illustrating a process 600 to create a plant model according to one embodiment of the invention.

Upon START, the process 600 creates a tree core having a trunk and a number of branches (Block 610). Next, the process 600 pre-coats the tree core with a clear oil-based liquid (Block 620). The clear oil-based liquid helps preventing rusting or oxidation of the tree core and enhancing the bonding with the coating. Then, the process 600 forms a coat to cover the tree core with a composite mixture (Block 630). The composite mixture may contain at least a water or oil-based paint component, a color pigment, a binder component, and a glue component.

Then, the process 600 determines if it is necessary to add texture (Block 640). If not, the process 600 proceeds to Block 660. Otherwise the process 600 creates the texture on the coated tree core (Block 650). Next, the process 600 glues a foliage cluster to the branches (Block 660). The foliage cluster includes poly-fiber strands spread thinly and bonded with turf having pre-determined color. The process 600 is then terminated.

Figure 7A:
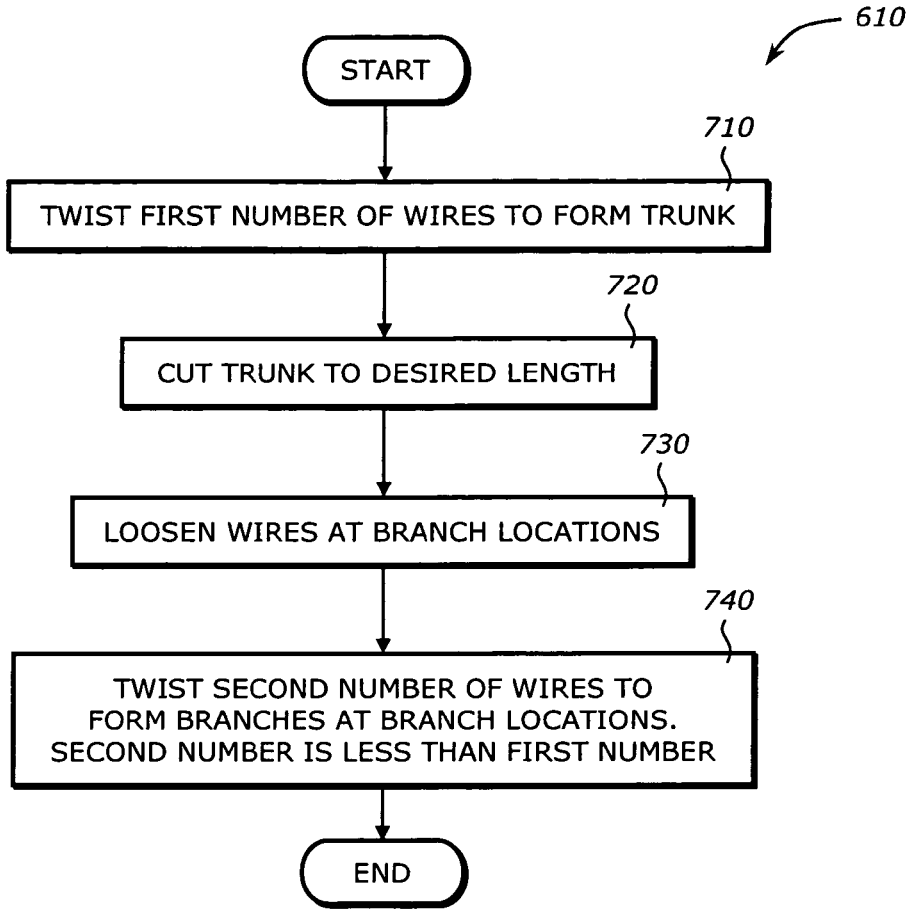
FIG. 7A is a flowchart illustrating a process to create a tree core according to one embodiment of the invention.

FIG. 7A is a flowchart illustrating the process 610 to create a tree core according to one embodiment of the invention.

Upon START, the process 610 twists or reels a first number of wires to form the trunk of the tree (Block 710). Then, the process 610 cuts the trunk to a desired length according to the type of tree (Block 720). Next, the process 610 loosens wires at pre-determined branch locations (Block 730). Then, the process 610 twists a second number of wires to form branches at the branch locations (Block 740). The second number of wires is less than the first number of wires because branches are typically smaller than the trunk. The process may then be repeated as many times as necessary to create more branches or sub-branches. The process 610 is then terminated.

Figure 7B:
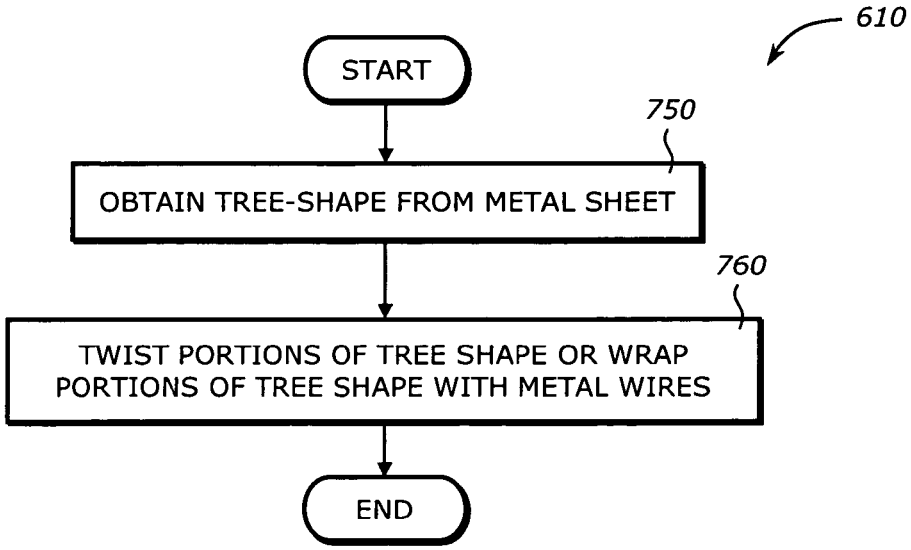
FIG. 7B is a flowchart illustrating a process to create a tree core according to another embodiment of the invention.

FIG. 7B is a flowchart illustrating a process 610 to create a tree core according to another embodiment of the invention.

Upon START, the process 610 obtains a tree shape from a metal sheet (Block 750). The tree shape includes a trunk and several branches as necessary. This may be achieved by cutting a pattern or pre-pressing. Next, the process 610 twists portions of the tree shape or wraps portions of the tree shape with metal wires to form a three-dimensional structure (Block 760). The process 610 is then terminated.

Figure 8:
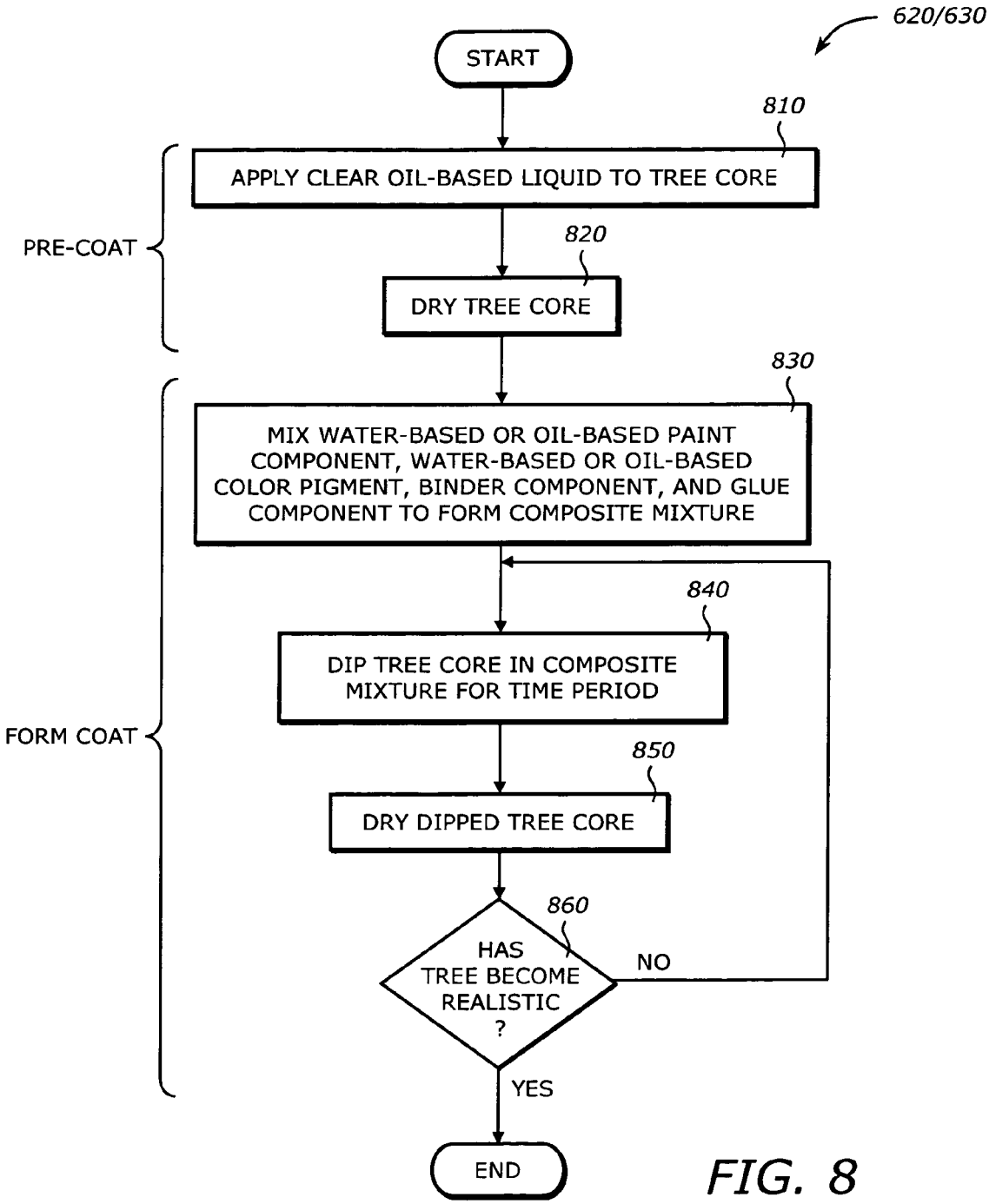
FIG. 8 is a flowchart illustrating a process to pre-coat and form a coat using the integrating receivers according to one embodiment of the invention.

FIG. 8 is a flowchart illustrating the process 620/630 to pre-coat and form a coat using the integrating receivers according to one embodiment of the invention.

Upon START, the process 620/630 applies a clear oil-based liquid to the tree core (Block 810). Next, the process 620/630 dries the tree core (Block 820). Then, the process 620/630 mixes a water or oil-based paint component, a water or oil-based color pigment, a binder component, and a glue component to form a composite mixture (Block 830).

Next, the process 620/630 dips the tree core in the composite mixture for a time period (Block 840). Then, the process 620/630 dries the dipped tree core (Block 850). Next, the process 620/630 determines if the plant model has become sufficiently realistic (Block 850). If not, the process 620/630 returns to Block 840 to continue dipping. Otherwise, the process 620/630 is terminated.

Figure 9:
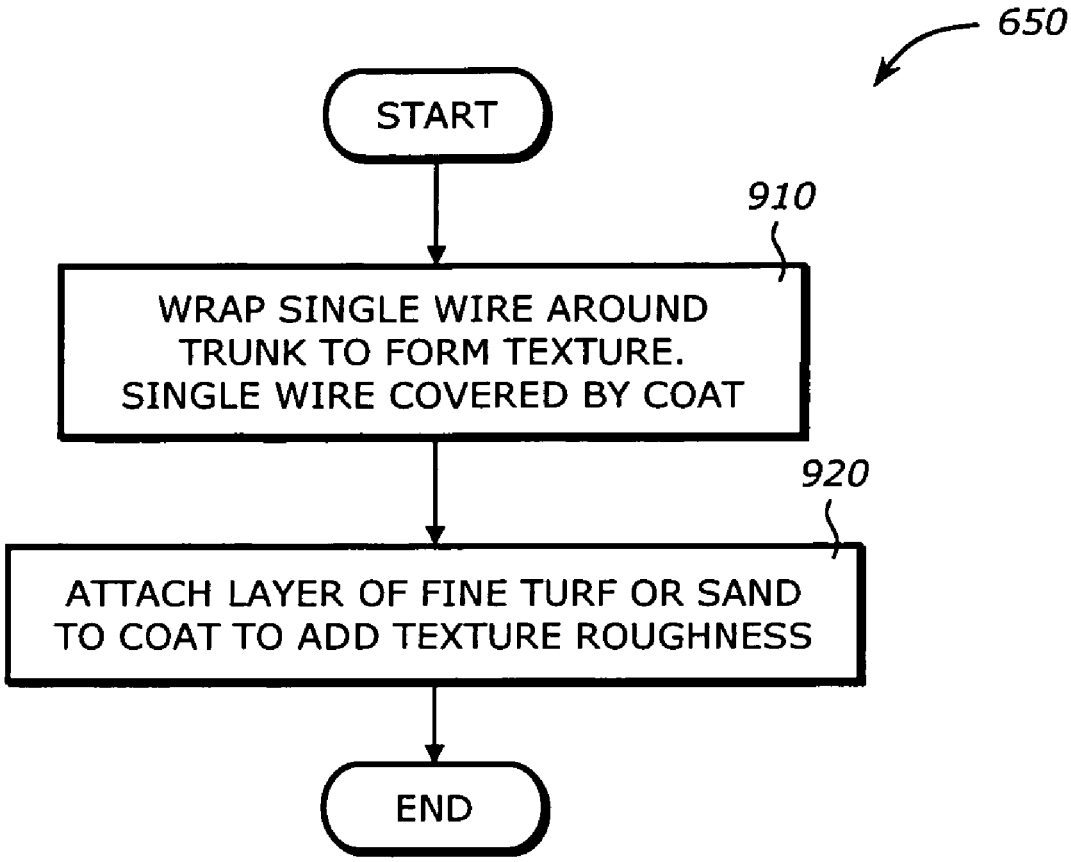
FIG. 9 is a flowchart illustrating a process to add texture according to one embodiment of the invention.

FIG. 9 is a flowchart illustrating the process 650 to add texture according to one embodiment of the invention.

Upon START, the process 650 wraps a wire around the trunk to form the texture (Block 910). The wire is covered by the coat formed by dipping into the composite mixture. Next, the process 650 attaches a layer of fine turf or sand to the coat to add the texture roughness as desired (Block 920). The process 650 is then terminated.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting.

What is claimed is:

1. A plant model comprising:

a trunk formed by a first number of twisted or reeled wires tapering from bottom part to upper part;

a plurality of branches, each formed by a second number of twisted or reeled wires from a branch location on the trunk, the second number being less than the first number;

a coating covering the trunk and the branches having a first layer of dried clear oil base and a second layer of dried composite mixture containing at least a paint component, a color pigment, a binder component, and a glue component; and a foliage cluster glued to the plurality of branches, the foliage cluster comprising fine poly-fiber strands spread thinly and bonded with a turf having a pre-determined color.

2. The plant model of claim 1 further comprising:

a wire wrapped around the trunk to form texture, the wire being covered by the coating.

3. The plant model of claim 1 further comprising:

a layer of fine turf or sand attached to the coating to add texture roughness.

4. The plant model of claim 1 wherein the paint component is water-based or oil-based.

5. The plant model of claim 1 wherein the color pigment is water-based or oil-based.

6. The plant model of claim 1 wherein the branch location has loosened twisted or reeled wires.

7. A method comprising:

creating a tree core having a trunk and branches;

pre-coating the tree core with a clear oil-based liquid;

forming a coat to cover the tree core with a composite mixture containing at least a paint component, a color pigment, a binder component, and a glue component; and gluing a foliage cluster to the plurality of branches, the foliage cluster comprising fine poly-fiber strands spread thinly and bonded with a turf having a pre-determined color.

8. The method of claim 7 wherein creating the tree core comprises:

twisting a first number of wires to form the trunk;

cutting the trunk to a desired height;

loosening the wires at branch locations; and twisting a second number of wires to form branches at the branch locations, the second number being less than the first number.

9. The method of claim 7 wherein pre-coating comprises:

applying the clear oil-based liquid to the tree core; and drying the tree core.

10. The method of claim 7 wherein forming the coat comprises:

mixing the paint component being one of a water-based and oil-based paint component, the color pigment being one of a water-based and oil-based color pigment, the binder component, and the glue component to form the composite mixture;

dipping the tree core in the composite mixture for a time period; and drying the dipped tree core.

11. The method of claim 7 further comprising:

creating texture on coated tree core.

12. The method of claim 11 wherein creating the texture comprises:

wrapping a wire around the trunk;

dipping the tree core wrapped with the wire in the composite mixture;

drying the wrapped tree core.

13. The method of claim 12 wherein creating the texture further comprising:

attaching a layer of fine turf or sand to the coat to add texture roughness.

14. The method of claim 7 wherein gluing the foliage cluster comprises:

preparing the foliage cluster into a thin sheet;

stretching the thin sheet;

cutting the thin sheet into small pieces; and gluing the small pieces on branches.

15. The method of claim 14 wherein preparing the foliage cluster comprises:

spreading poly fiber strands into the thin sheet;

spraying a water or oil-based glue evenly over the thin sheet;

dipping the thin sheet into a turf having a desired color;

drying the dipped thin sheet until the poly fiber strands bonds with the turf.

16. The method of claim 7 wherein creating the tree core comprises:

obtaining a tree shape including the trunk and branches; and creating a three-dimensional (3-D) structure from the cut tree shape.

17. The method of claim 16 wherein obtaining the tree shape comprises:

cutting a two-dimensional pattern of the tree shape from a metal sheet.

18. The method of claim 16 wherein creating the 3-D structure comprises:

twist portions of the tree shape.

* * * * *